United States Patent [19]

Libby et al.

[11] 4,116,554

[45] Sep. 26, 1978

[54] OPTICAL REDUCTION SYSTEM FEATURING THE PROVISION OF BORDERS

[75] Inventors: Edwin Langford Libby, Longmont; Myrl J. Miller, Boulder, both of Colo.

[73] Assignee: International Business Machines Corporation, Armonk, N.Y.

[21] Appl. No.: 825,337

[22] Filed: Aug. 17, 1977

Related U.S. Application Data

[60] Division of Ser. No. 608,941, Aug. 29, 1975, which is a continuation of Ser. No. 301,681, Oct. 27, 1972, which is a continuation of Ser. No. 87,508, Nov. 6, 1970.

[51] Int. Cl.[2] ..... G03G 15/00

[52] U.S. Cl. ..... 355/11; 355/57; 355/60

[58] Field of Search ..... 355/7, 8, 11, 55–57, 355/60

[56] References Cited

U.S. PATENT DOCUMENTS

| | | | |
|---|---|---|---|
| 2,927,503 | 3/1960 | Zollinger | 88/24 |
| 3,395,610 | 8/1968 | Evans et al. | 88/24 |
| 3,437,410 | 4/1969 | Tregay et al. | 355/57 |
| 3,542,467 | 11/1970 | Ferguson et al. | 355/8 |
| 3,614,222 | 10/1971 | Post et al. | 355/8 |
| 3,703,334 | 7/1970 | Knechtel et al. | 355/57 X |

*Primary Examiner*—William M. Shoop
*Attorney, Agent, or Firm*—Charles E. Rohrer

[57] ABSTRACT

The optical system disclosed is incorporated in a copying machine and has provision for changing magnification of original documents of diverse sizes while maintaining a common image plane projection and enabling the use of common reference edges at a selected reference corner for any original document that might be used and also either maintains common reference edges in the image plane or produces borders on the reduced-sized image without deliberately causing the center of the reduced image to coincide with the center of the non-reduced image. The system contemplates the combined movement of the lens element as well as one of a pair of mirrors to insure that the original document surface and the image plane remain in their fixed positions, regardless of the magnification factor chosen. The lens element is movable forwardly and reversely along the optical path as well as transversely with respect thereto.

5 Claims, 9 Drawing Figures

OPTICAL REDUCTION SYSTEM FEATURING THE PROVISION OF BORDERS

BACKGROUND OF INVENTION AND PRIOR ART

This is a division of application Ser. No. 608,941 filed Aug. 29, 1975; which was a continuation of Ser. No. 301,681 filed Oct. 27, 1972; which was a continuation of Ser. No. 87,508 filed Nov. 6, 1970.

The following U.S. patents are representative of the prior art:

U.S. Pat. No. 2,431,612
U.S. Pat. No. 2,821,882
U.S. Pat. No. 2,927,503
U.S. Pat. No. 2,940,358
U.S. Pat. No. 3,237,516
U.S. Pat. No. 3,329,029
U.S. Pat. No. 3,437,410
U.S. Pat. No. 3,476,478

While the majority of the patents listed above are directed to the capability of changing magnification in an optical system, none of the patents is believed anticipatory to the arrangement set forth herein for maintaining a constant document plane location and image plane location while providing borders along opposite edges of the reduced image without deliberately causing the center of the reduced-sized image to coincide with the center of a non-reduced image.

SUMMARY OF THE INVENTION

The present invention is set in a high-speed copier environment producing on the order, and as an example, 125 copies per minute. The high-speed copying system has the customary electrophotographic facilities, particularly including a photoconductor medium, such as a belt, and having an image plane toward which images of original documents are projected by the optical system. The system used in the copier machine is what is commonly known as a folded optical system, meaning that light from the original is reflected toward one or more reflecting surfaces that change the direction of the light path and that permit a more compact arrangement of elements.

In typical copying work, documents may range in size, as an example, from 8.5 × 11 inches to 11 × 17 inches. An intermediate size of 8.5 × 14 inches may also be accommodated. For ease of operation, it is desirable that the system permit placement of the original documents in a convenient fashion. This is permitted in the present system by establishing a longitudinal reference edge and a lateral or transverse reference edge as locating edges for placement of original documents. These edges remain fixed regardless of the document size placed on the machine for imaging, thereby facilitating operations. It is customary that the photoconductor medium, such as a belt, be positioned in the machine for movement past an image station, the image station remaining fixed in the machine. In accordance with other aspects of the invention, provision is made for projecting images derived from original documents, regardless of their size (within the constraints of the particular machine implementing this invention), onto the same effective image area on the photoconductor medium. In a typical case, this may contemplate an image area of 8.5 × 14 inches. Thus, regardless of the size of the original document, the image derived therefrom is projected into essentially the same image area on the photoconductor belt. This arrangement offers advantages such as simplified copy paper feed, constant image-to-developer time, and constant reference edges for random size, automatically fed documents.

In order to effect a change in magnification, whether going from a larger image to a smaller image, or vice versa, facilities are provided in the system for moving the lens element along the optical path from a first position to a second position and return. With a simple lens, as opposed to a zoom lens, such a movement requires a change in total conjugate length. This change is performed in the present system by the inclusion of a mirror reflecting element that is movable from a first location to a second location in synchronism with movement of the lens element. To insure the projection of the image into the desired image plane area on the photoconductor medium, the lens element is further translated in a transverse direction with respect to the optical path, thereby insuring that the images transmitted from the original document plane are accurately aligned with respect to the original document as well as the image plane on the photoconductor element. In this invention reduced-sized images are located in the image area so as to provide borders on opposite edges of the image without deliberately causing the center of the reduced image to coincide with the center of a non-reduced image.

OBJECTS

The object of this invention is to provide an optical system for a document copier machine which has stationary object and image planes so that reduced images are provided with borders without deliberately causing the center of the reduced image to coincide with the center of the non-reduced image. invention is to provide an optical system with facilities for changing magnification of images projected therein from a larger size to a smaller size, and vice versa.

Still another object of the present invention is to provide an optical system that incorporates movable elements such as a lens and at least a mirror movable in a manner to change the magnification of images projected therein and enabling the placement of original documents against common reference edges regardless of size.

A further object of the present invention is to provide a optical system, particularly useful in an electrophotographic environment, for projecting images of original documents of diverse sizes to a common image plane area on a photoconductor medium with consequent reduction or magnification, as required, to insure the accommodation of the image in the image area.

A further object of the present invention is to provide an optical system for changing magnification of images projected therein and projecting images toward a common image plane with provision for movement of a lens element both longitudinally along an optical path as well as transversely with respect thereto.

The foregoing and other objects, features, and advantages of the invention will be apparent from the following more particular description of the preferred embodiment of the invention as illustrated in the accompanying drawings.

DRAWINGS

In the drawings:

FIG. 1 is a schematic diagram of a high-speed copier system utilizing a photoconductive belt for the conveyance of images flashed thereon from an original document and conveyed by an optical system in accordance with the present invention.

FIGS. 2*a* and 2*b* illustrate some of the optical principles involved in making a change in magnification from 1.02 to 0.66 in a system of the nature of that shown in FIG. 1.

FIG. 6 also shows an edge shift to produce borders on a reduced image in an image area.

DETAILED DESCRIPTION

The High-Speed Copier System

Figure 1:
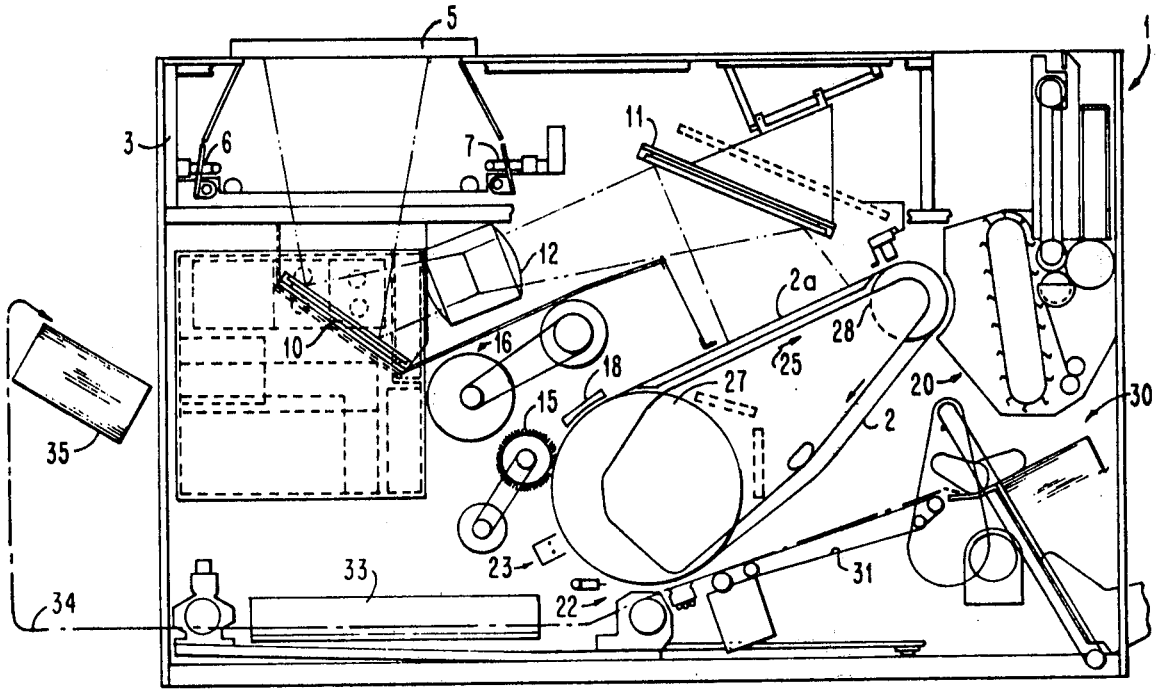

FIG. 1 illustrates a high-speed copier unit 1 incorporating the present invention. The unit includes a photoconductor belt 2 and has a main frame 3 supporting various elements for producing a multitude of copies at high speeds from original documents. An original is positioned on a transparent plate in the stationary original document plane 5 and illuminated by flash lamps 6 and 7 in timed relation with movement of belt 2. An optical system including mirrors 10 and 11 and lens element 12 project the image of the original toward a stationary image plane 2*a* on moving belt 2.

The unit in FIG. 1 incorporates the customary electrophotographic facilities for producing copies. These include a cleaning brush 15 with associated cyclone cleaning system 16, a charge corona station 18, the image plane 2*a*, previously mentioned, a developer station 20, a transfer station 22, and a preclean corona station 23. Belt 2 is mounted for movement as indicated by arrow 25 on drum driving elements 27 and 28. A paper supply 30 accommodates a large quantity of individual sheets of paper that are fed by various devices including a belt 31 to the transfer station 22 for transfer of images in timed relation with movement of belt 2. Following such transfer, the image is fused by fuser 33, passes by transportation means 34, not shown, to a completion station, such as a sorter copy bin 35.

Change in Conjugate Length Due to Lens Movement

Figure 2B:
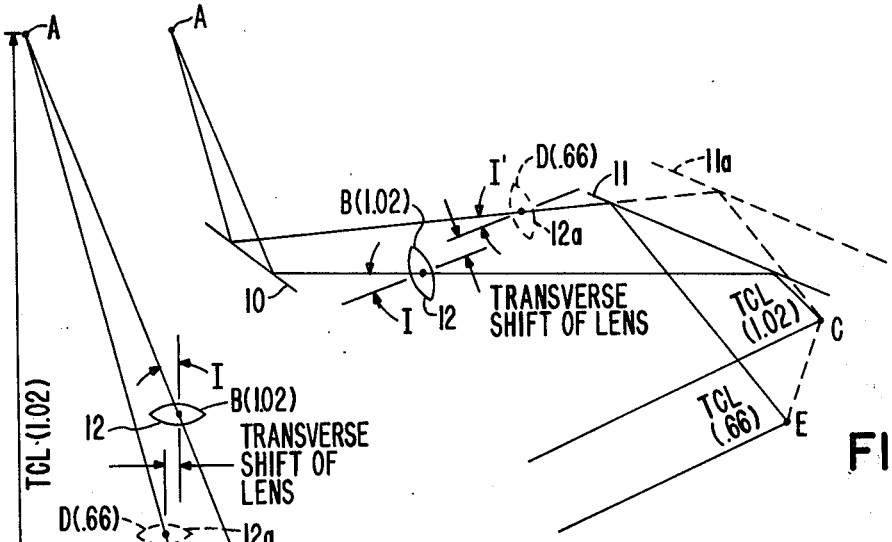
Figure 2A:
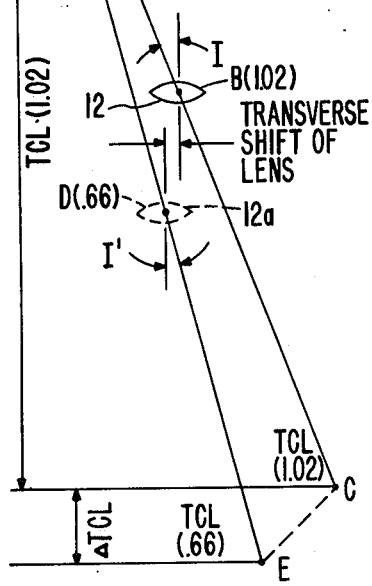

FIGS. 2*a* and 2*b* represent unfolded and folded optical systems, respectively, illustrating certain of the parameters that need to be taken into account when motion is imparted to a lens element in the systems. In FIG. 2*a*, point A represents the location of a corner referenced original document, point B represents the location of the lens element with a magnification factor of 1.02, and point C is the location of the image of point A at the total conjugate length (TCL) for this 1.02 magnification. Movement of the lens from point B to point D effects a change in magnification to 0.66 but also requires that there be an increase in the total conjugate length in comparison with the original total conjugate length so that image focal sharpness is maintained. It is important to note that point E, the image of point A at 0.66 magnification, does not coincide with point C, the image of point A at 1.02 magnification. In fact, the change in TCL has resulted in a shift of the entire image plane which raises a serious problem for electrophotographic machines such as shown in FIG. 1 where the document plane 5 containing point A and the image plane 2*a* are both stationary. This change in TCL is remedied in FIG. 2*b*, explained below.

Note also that FIG. 2a shows a transverse shift in the position of the lens as well as shift in the magnification dimension. The purpose of that transverse shift is to align in the image plane one of the reference edges forming the corner defining points C and E. A second transverse dimension of lens movement is necessary for aligning in the image plane the other reference edge defining points C and E but is not shown in the two-dimensional drawings of FIGS. 2*a* and 2*b*.

FIG. 2*b* provides a solution for the problem of making the image plane for 0.66 magnification coincident with the image plane at 1.02 magnification by providing a folded optical version of the relationships just described in connection with FIG. 2*a*. Points A, B, C, D, and E are essentially the same as those shown in FIG. 2*a*. The configuration shows mirror 10 held stationary and mirror 11 movable from the solid line to the dashed line position to convey the images during operation of the system. The combined movements of the lens element from position B to D, and the mirror 11 from the solid line to the dashed line position provides for the change in the total conjugate length the required distance and (together with the two axes of transverse shift of the lens) makes possible the coincidence of point E and point C. That is, the light image continues on from lens 12 at point D along the dashed path for reflection from mirror 11 in the dashed position so that the image arrives at and becomes exactly coincident with point C rather than its original solid line travel and arrival at the non-coincident point E illustrated. This maintains the image location in a constant position, at point C irrespective of whether a 1.02 or 0.66 magnification factor exists. If mirror 11 were to remain in the solid line position shown in FIG. 2*b*, then the image would be projected from lens 12*a* at position D to point E rather than to point C. It is desirable that the image be projected to point C regardless of whether a magnification ratio of 1.02 or 0.66 is used. As is known in the art, the total conjugate length comprises the first conjugate, i.e., the distance from the object plane to the lens plus the second conjugate, i.e., the distance from the lens to the image plane.

Typical Original Documents, Lens Movement, and Image Plane

Figure 3:
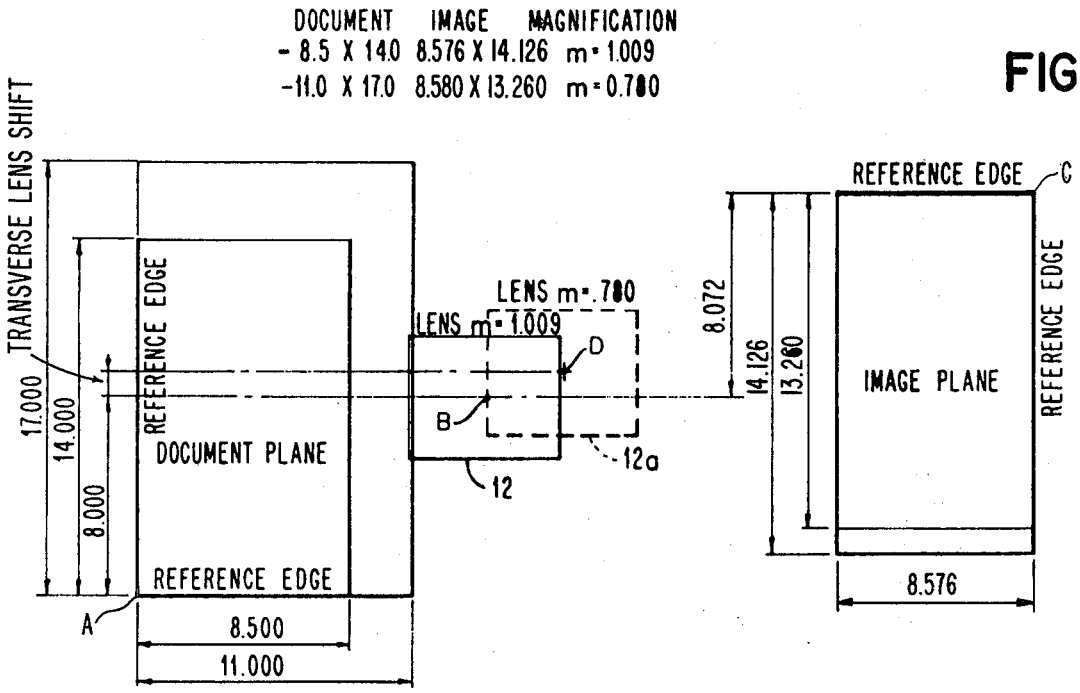
FIG. 3 illustrates the relationships of the original documents placed against common reference edges to the ultimate image plane on the photoconductor belt in the system of FIG. 1 together with lens motion where the magnification ratios are 1.009 and 0.78.
Figure 4:
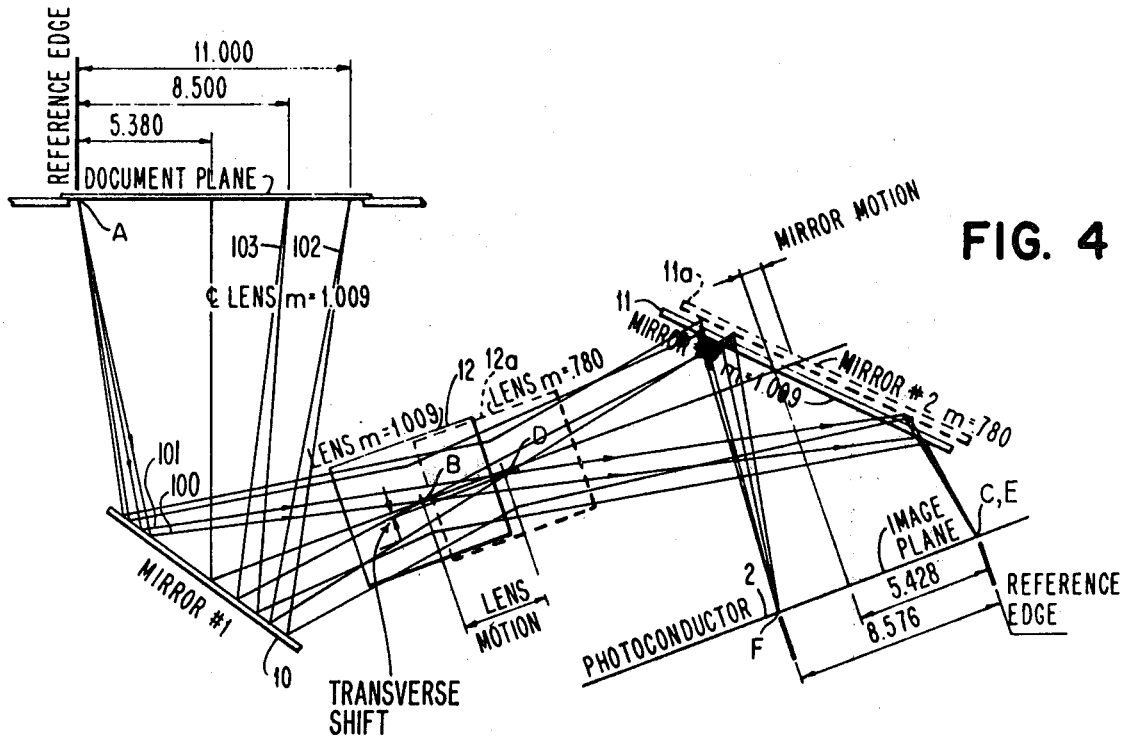
FIG. 4 is a more detailed rendering of the optical system incorporated in the system of FIG. 1, once again illustrating magnification ratios of 1.009 and 0.78.

FIG. 3 illustrates typical original document sizes of 8.5 × 14 inches and 11 × 17 inches, each such document being positioned against two reference edges forming an angle or reference corner on the top surface of the copy machine shown in FIG. 1. FIG. 3 is intended to be diagrammatic of the actions involved. FIG. 4 is somewhat more detailed, and FIGS. 5–9 illustrate structures of a typical embodiment. Referring again to FIGS. 3 and 4, reference edges A and C are simply extensions respectively, of points A and C in FIG. 2b. Lens element 12 is movable from the solid line position with a magnification factor of 1.009 to the dashed line position indicated at 12*a* with a magnification factor of 0.78. These are slightly different ratios than the 1.02 and 0.66 ratios discussed in connection with FIGS. 2*a* and 2*b*, but the underlying principles are the same. As shown in FIG. 3, the image is maintained in a constant relationship with respect to the photoconductor belt, the two reference edges on the image plane representation corresponding respectively to their counterparts in the document plane portion of FIG. 3. The net effect of the arrangement is such that all documents from the smallest to the largest size will be referenced in an identical corner on the image plane. It is obvious that the fact that the reference corner on the image plane is maintained does not imply that it always falls on the same physical spot on the moving photoconductor belt.

As will be clarified in later sections, as lens element 12 is moved from the solid line position to the dashed line position illustrated in FIG. 3 along the optical path, it is also moved transversely with respect to the optical path to project the images of the original documents properly even though their centers are displaced from one another due to variance in their dimensions.

Lens and Mirror Relationships

FIG. 4 illustrates the relationships of the lens and mirrors under various conditions of operations and takes into account the facilities for changing magnification. Points A, B, C, and D correspond to similarly designated points in FIG. 2*b*. One of the reference edges is illustrated for the original document and three transverse dimensions of 5.38, 8.5, and 11 inches are shown. Lens 12 is moved from point B to point D, and conversely, in a range of magnification from 1.009 to 0.78. Coupled with the lens movement is movement of the mirror 11 to position 11*a*, and conversely, in a corresponding range to properly convey the images from lens 12 to the image plane and corresponding to the magnification values at 1.009 and 0.78. Light ray 100 is shown emanating from point A on the document plane and after reflection by mirror 10, it passes through the center of lens 12 at 1.009 magnification (which is point B) to mirror 11, whereupon it is reflected to the image plane at point C. Light ray 101 also emanates from point A and passes through the center of lens 12 at 0.78 magnification (which is point D) to the mirror at position 11*a*, whereupon it is reflected to the image plane at point C. Thus, point A is imaged at point C regardless of the magnification ratio.

The lens is also shown moved in FIG. 4 in a direction transverse to the optical axis. Again, as in FIGS. 2*a* and 2*b*, if the reference corner represented by the intersection of two reference edges at point C is to be maintained at different magnification ratios, another transverse movement must be made, not shown in the two-dimensional drawing of FIG. 4.

It is noteworthy to observe that light ray 102 emanating from the edge of the 11-inch document width on the document plane passes through the optical system at 0.78 magnification to arrive at the image plane at point F, thus defining an image width of 8.58 inches. This is essentially the same width as the 8.576 inches shown on FIG. 4 for image width obtained from the edge of the 8.5 document width, light ray 103, at 1.009 magnification.

Lens and Mirror Structure

Figure 5:
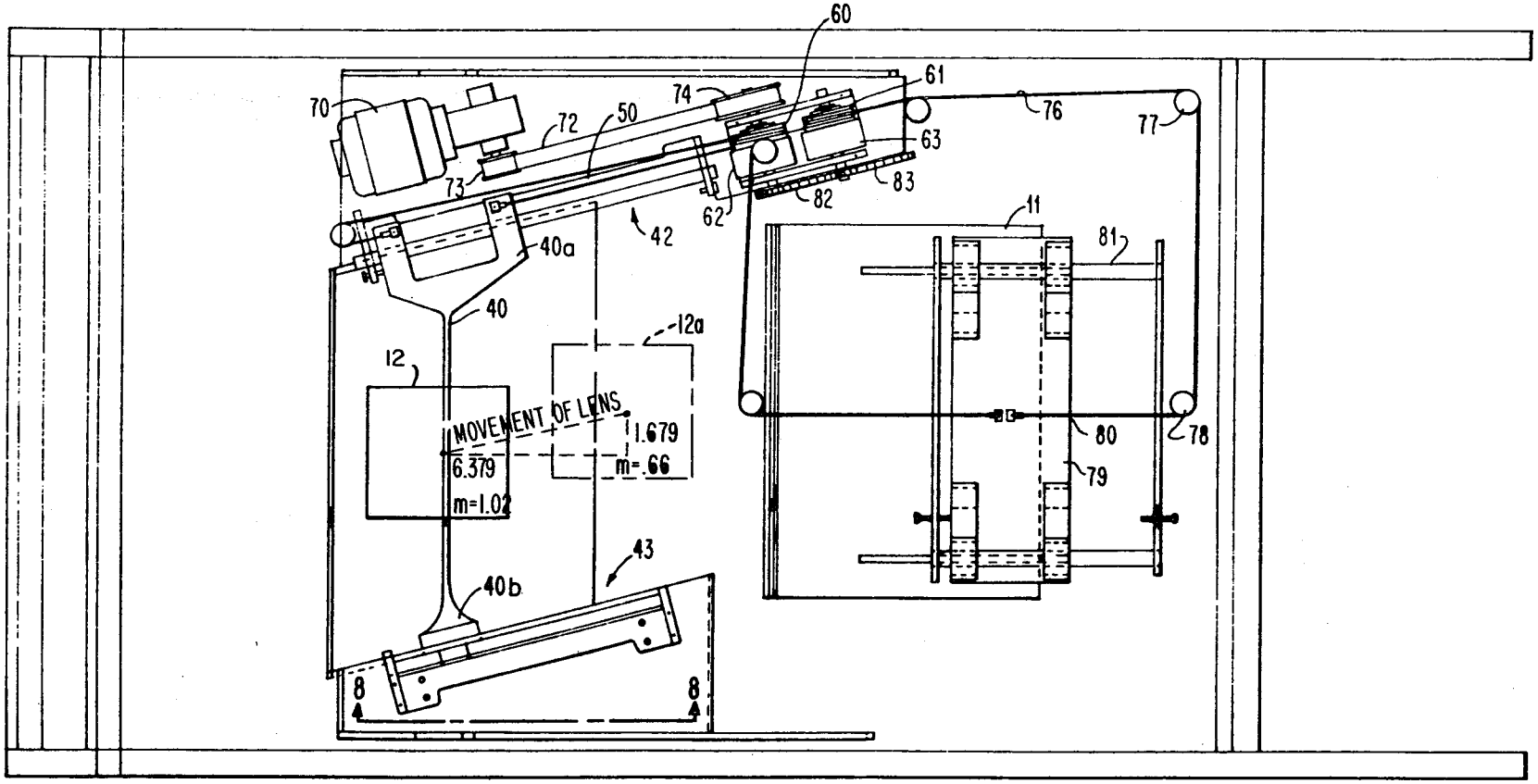
FIG. 5 is a top elevation of various components included in the optical system shown in FIG. 4 except that magnification ratios of 1.02 and 0.66 are shown.
Figure 6:
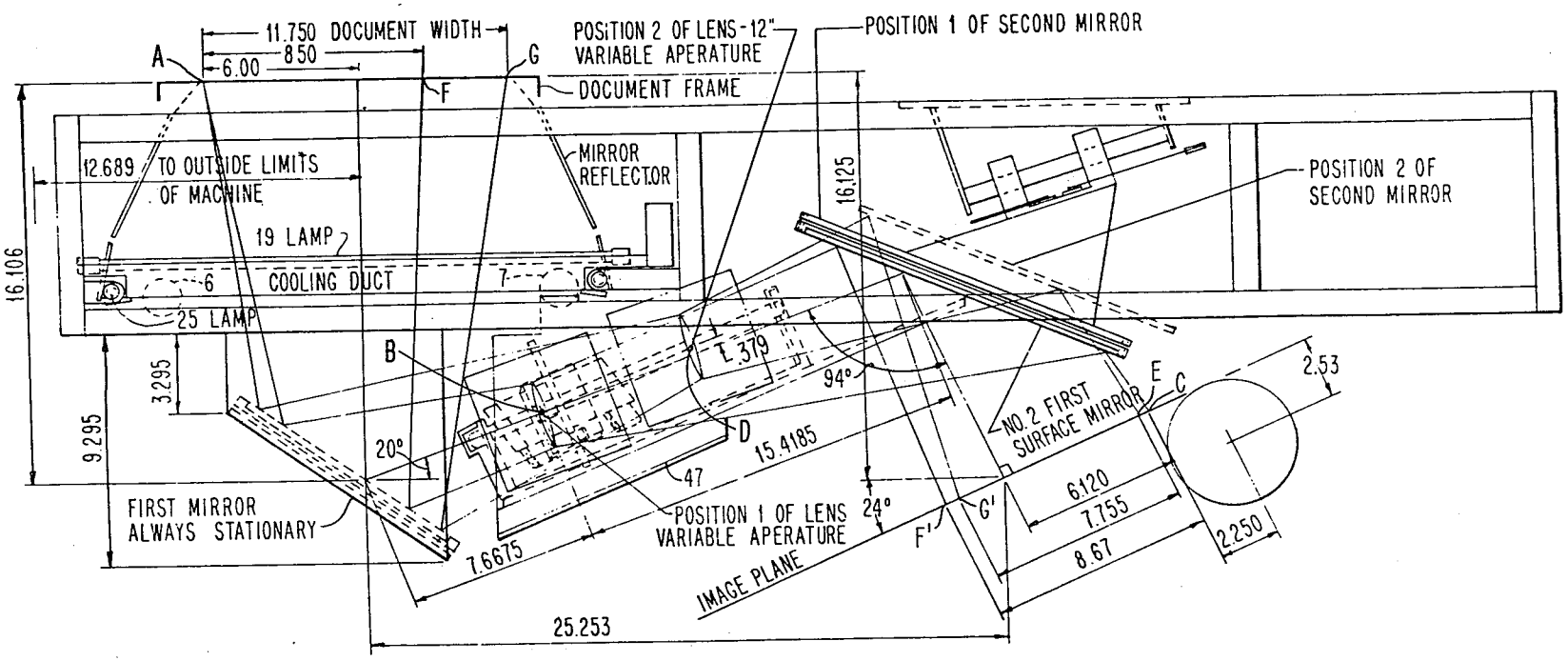
FIG. 6 shows a side elevational view of the optical components of the machine at magnification ratios of 1.02 and 0.66.
Figure 7:
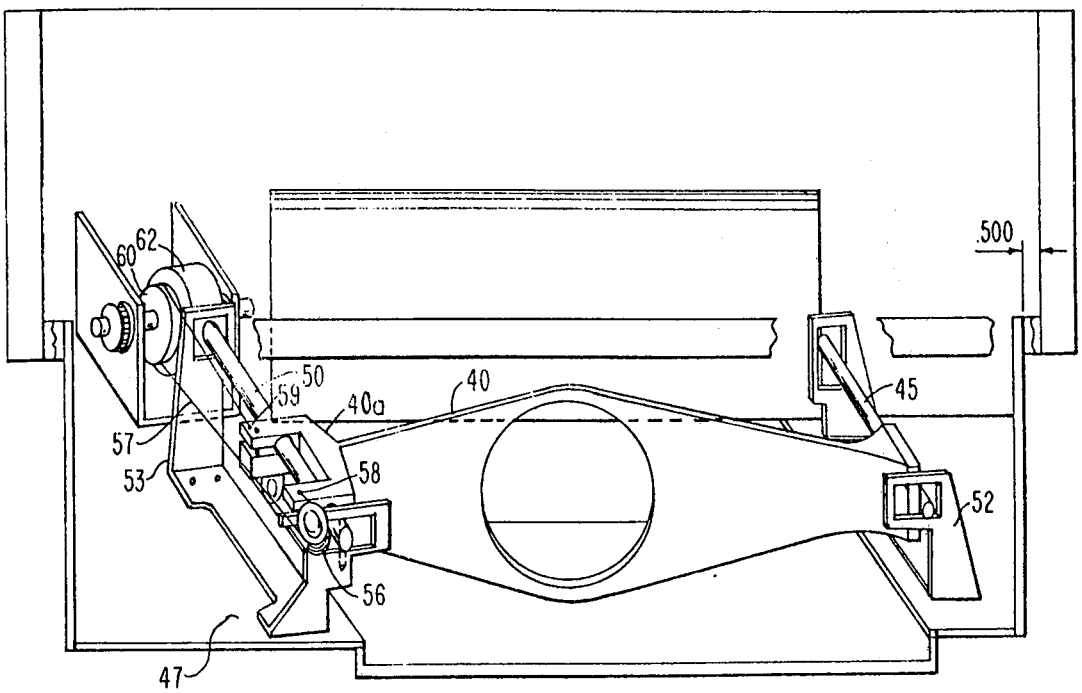
FIG. 7 shows some of the lens transporting structure of FIG. 5 in greater detail.
Figure 8:
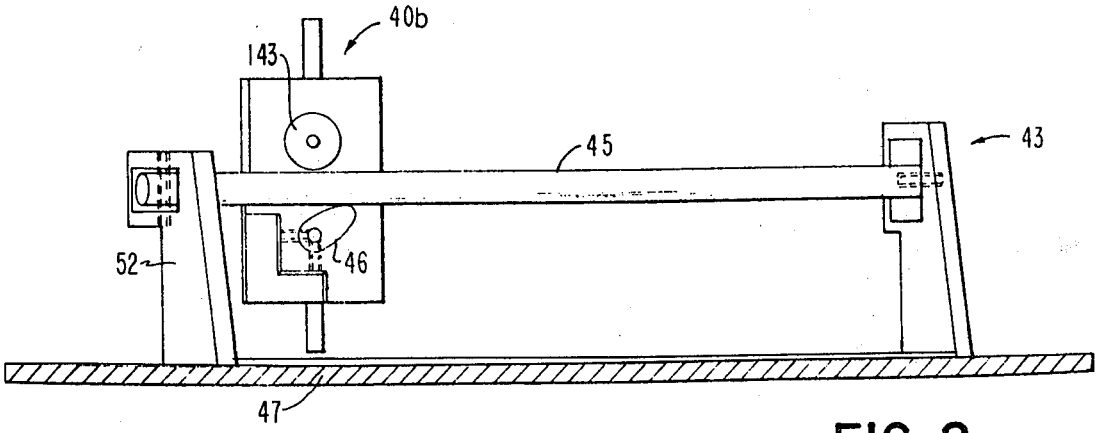
FIG. 8 is an end elevation of guide rails taken on the line 8—8 in FIG. 5.

FIGS. 5–8 illustrate various structural considerations of the optical system according to the present invention. FIG. 5 is a top elevation of the optical system illustrating the translational movement of lens element 12 in a horizontal plane transversely with respect to the optical path during a change in magnification ratio. Portions of the hardware are also shown in FIGS. 6–8. Typical original document widths of 8.5 and 11 inches are shown in FIG. 4, together with 5.38 inches which is the dimension from the reference edge to the optical axis at 1.009 magnification, while other original document widths (also typical) of 8.5 and 11.75 are illustrated in FIG. 6, together with 6 inches which is the dimension from the reference edge to the optical axis at 1.02 magnification.

The structures shown facilitate the change in magnification of the system from one extreme to another. As may be observed, movement of the lens element from one position where the lens element is designated "12" to the other position "12*a*" and movement of the movable mirror from the position where it is designated "11" to the position "11*a*" corresponds to the related movement shown in FIG. 2*b* and also is termed movement from "position 1 to position 2." The converse movement of lens 12 and mirror 11 also can be related to FIG. 2*b* and is termed movement from "position 2 to position 1." Position 1 of the elements is used, as an example, during imaging of an 8.5 × 14-inch original document with a magnification ratio of 1.009, while position 2 of the elements is used, as another example, during imaging of an 11 × 17-inch original document with a magnification ratio of 0.78, as shown in FIG. 3. As may be seen in FIG. 5, lens 12 is mounted in a lens supporting means 40 having end portions 40*a* and 40*b* supported for movement by guide assemblies 42 and 43. Guide assembly 43 is shown particularly in FIG. 8 where it is shown that a thoroughly stable support is given to lens element 12 by a three-point mounting of supporting member 40 comprising the U-shaped bracket portion 40*a* (two points) and the single supporting portion 40*b*. Typical of the supporting portions 40*a* and 40*b* is portion 40*b* carrying a roller element 143 that is movable along guide rod 45. A predetermined clearance to enable a snug fit of roller 143 against guide rod 45 is obtained by eccentric 46 that is adjusted to enable free movement with very slight clearance. This maintains integrity of the elements during magnification change of the system. As can be seen in FIG. 6, the lens support member 40 is further positioned at an angle with respect to the horizontal by a plate 47, thereby insuring that as lens 12 moves from its first position with 1.02 magnification to its second position of 0.66 magnification, it also is moved upwardly essentially along the optical path but with some slight displacement which, as indicated, is 0.379 inches. This slight shift of the original optical axis relocates the image, thus insuring that the reduced image remains within the full-size image area. Common image reference edges, or one common image reference edge, may be maintained as they are in FIGS. 3 and 4 where points C and E were made to coincide, but FIG. 6 shows that the reduced image at 0.66 magnification can be located in the image area with some displacement relative to the prior image produced at the 1.02 magnification. In FIG. 6, the maximum size document, 11.75 inches, defined by points A and G on the document plane, results in an image width of only 7.755 inches, defined by points E and G', on the image plane at 0.66 magnification. This is in contrast to the 8.67 image width defined by points C and F'produced at 1.02 magnification from the 8.5-inch wide document defined at the document plane by points A and F. Thus, it is possible to shift the edges of the reduced image (7.755 inches) in the 8.67-inch image area. The image edge shift is obtained by shifting the lens a vertical distance of 0.379 inches as shown in FIG. 6.

FIG. 7 shows guide rail 45, previously referred to, and the opposite guide rail 50 that supports the U-shaped portion 40*a* of lens support member 40. Guide rod 45 is supported by bracket member 52 and guide rod 50 is supported by bracket member 53. Bracket member 53 further supports a pulley member 56 carrying a cable 57 which is attached at one end to a pin 58 on portion 40*a* of support member 40. The opposite end of cable 57 is attached at 59 to the other part of the U-shaped portion 40*a*. Cable 57 passes over a driving drum 60 forming part of a slip clutch 62 that can also be seen in FIG. 5.

The primary source of driving for the magnification structures is motor 70 coupled by drive belt 72 and pulleys 73 and 74 to slip clutch 62 and a second slip clutch 63 that serves to drive the mirror moving elements as may best be seen in FIG. 5. A cable 76 is coupled by pulleys 77 and 78 to a mirror supporting member 79 at point 80. Gear elements 82 and 83 are engaged to transmit driving force from the drive shaft of pulley 74 to slip clutch 63.

Since a common drive motor 70 is coupled to slip clutches 60 and 61, a combined movement of lens 12 as well as mirror 11 occurs whenever a change in magnification is required either from a larger size to a smaller size, or vice versa.

In operation, whenever a change in position of the lens element 12 and mirror 11 are required, motor 70 is energized, driving slip clutches 60 and 63 for two or three seconds. Driving by motor 70 of slip clutches 60 and 63 continues until such time as lens supporting member 40 reaches the stops at either end of the supporting brackets 52 and 53 at which time slippage occurs in the clutch 60 and until mirror supporting member 79 in a comparable manner reaches its stops on supporting bracket 81. The driving of the lens and mirror are preferably arranged to occur concurrently but may be arranged so that they are accomplished in sequence, i.e., the lens is first driven to its stop locations and then the mirror is driven to its stop locations.

It may thus be seen that a convenient arrangement is provided for changing magnification in a system of this nature while maintaining integrity of the image conveyed to the image plane, accommodating original documents of various sizes, and enabling the use of common reference edges for alignment of both documents while producing borders on their reduced images without deliberately causing the center of the reduced image to coincide with the center of the non-reduced image.

While the invention has been particularly shown and described with reference to a preferred embodiment, it will be understood by those skilled in the art that various changes in form and detail may be made without departing from the spirit and scope of the invention.

What is claimed is:

1. An electrophotographic copying machine for copying documents at various discrete magnification ratios, said documents typically of various rectangular sizes, comprising:

a transparent plate mounted on said machine for supporting said documents of various sizes in a stationary document plane, said documents located on said document plane along a common reference edge;

flash lamp means for illuminating said document plane, mounted adjacent to said transparent plate;

a photoconductive surface mounted in said machine;

power means operatively connected to said photoconductive surface for moving said surface in said machine;

an optical system including a mirror element and a lens member, mounted in said machine for projecting light received from the illuminated document plane to a stationary image plane on said photoconductive surface;

a lens supporting member mounted in said machine for movement, said movement including a component along the optical path defined by the axis of the light directed from said document plane to said photoconductive surface in order to provide different magnification ratios;

lens guide means mounted in said machine for supporting said lens supporting member, to provide a guideway for lens movement, said guideway inclined at an angle to said optical path in order to provide lens movement transverse to said path; and drive means operatively connected to said lens supporting member to move said lens supporting member to a first position to produce a first image in an image area sized approximately the same as a first document area, and to move said lens supporting member to a second position to produce a reduced second image, said lens guide means and said drive means cooperating to shift said second image within said image area to produce borders along opposite edges of said second image, said lens guide means and said drive means further cooperating to shift said second image without deliberately causing the center of said second image to coincide with the center of said first image.

2. The machine of claim 1 wherein said guideways are rails transversely inclined to the optical path in one dimension in order to shift the second image to provide borders along two opposite edges of said second image.

3. The machine of claim 1 including means for maintaining focal sharpness at said image plane at all lens positions.

4. The machine of claim 3 wherein said guideways are rails transversely inclined to the optical path in a vertical dimension in order to shift the second image to provide borders along two sides of said second image.

5. An electrophotographic copying machine for copying documents at various discrete magnification ratios, said documents typically of various rectangular sizes, comprising:

a transparent plate mounted on said machine for supporting said documents of various sizes in a stationary document plane, said documents located on said document plane along a common reference edge;

illuminating means for illuminating said document plane, mounted adjacent to said transparent plate;

a photoconductive surface mounted in said machine;

power means operatively connected to said photoconductive surface for moving said surface in said machine;

an optical system including a mirror element and a lens member, mounted in said machine for projecting light received from the illuminated document plane to a stationary image plane on said photoconductive surface;

a lens supporting member mounted in said machine for movement, said movement including a component along the optical path in order to provide different magnification ratios;

lens guide means mounted in said machine for supporting said lens supporting member to provide a guideway for lens movement, said guideway providing a component of lens movement perpendicular to the optical path defined by the axis of the light directed from said document plane to said photoconductive surface; and drive means operatively connected to said lens supporting member to move said lens supporting member to a first position to produce a first image in an image area sized approximately the same as a first document area, and to move said lens supporting member to a second position to produce a reduced second image, said lens guide means and said drive means cooperating to shift said second image within said image area to produce borders along opposite edges of said second image, said lens guide means and said drive means further cooperating to shift said second image without deliberately causing the center of said second image to coincide with the center of said first image.

* * * * *

UNITED STATES PATENT AND TRADEMARK OFFICE

CERTIFICATE OF CORRECTION

PATENT NO. 4,116,554

DATED Sep. 26, 1978

INVENTOR(S) : Edwin Langford Libby and Myrl J. Miller

It is certified that error appears in the above-identified patent and that said Letters Patent are hereby corrected as shown below:

Column 2, line 35 after "image.", delete "invention is to provide";

Column 2, delete line 36 through line 58.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*